US005763848A

United States Patent [19]

Hakamata et al.

[11] Patent Number: 5,763,848

[45] Date of Patent: Jun. 9, 1998

[54] ELECTRODE FOR VACUUM CIRCUIT BREAKER

[75] Inventors: Yoshimi Hakamata; Toru Tanimizu; Masato Kobayashi; Hitoshi Okabe; Katsuhiro Komuro; Akira Wada, all of Hitachi, Japan

[73] Assignee: Hitachi, Ltd., Tokyo, Japan

[21] Appl. No.: 636,788

[22] Filed: Apr. 23, 1996

[30] Foreign Application Priority Data

Apr. 26, 1995 [JP] Japan ..... 7-101901

[51] Int. Cl.[6] ..... H01H 33/66

[52] U.S. Cl. ..... 218/128

[58] Field of Search ..... 218/118, 121, 218/123–133, 146; 200/275, 279

[56] References Cited

U.S. PATENT DOCUMENTS

| | | | |
|---|---|---|---|
| 3,280,286 | 10/1966 | Ranheim | 200/144 |
| 3,711,665 | 1/1973 | Dethlefsen | 200/144 B |
| 4,553,002 | 11/1985 | Slade | 200/144 B |

FOREIGN PATENT DOCUMENTS

| | | | |
|---|---|---|---|
| 60-74320 | 4/1985 | Japan | H01H 33/66 |
| 61-29027 | 2/1986 | Japan | H01H 33/66 |
| 63-158722 | 7/1988 | Japan | H01H 33/66 |

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

An electrode for a vacuum circuit breaker provided with a connecting portion made of a material having the same resistivity as the arc running face portions across the corresponding arc guiding channel at the outer circumferential end thereof, wherein when the outer diameter of the connecting portion is $D_1$ and the inner diameter of the connecting portion is $D_2$, the width of the connecting portion is designed so that the ratio $D_2/D_1$ is in a range of more than 0.9 and less than 1.0. An arc generated between the electrodes is magnetically driven over the arc running face portions via the connecting portion so that the current interrupting capacity of the electrode is increased and the size and weight of the electrode are reduced.

16 Claims, 3 Drawing Sheets

ELECTRODE FOR VACUUM CIRCUIT BREAKER

BACKGROUND OF THE INVENTION

1. Field of the Invention

The present invention relates to an improved electrode having arc guiding channels for a vacuum circuit breaker.

2. Background Art

From the past, an electrode for a vacuum circuit breaker has been provided with a plurality of spiral shaped channels so as to control current passage within the electrode and to constitute a round trip loop shaped current passage in the circumferential direction thereof. With this electrode an arc generated between the electrodes is driven by the magnetic field induced by the loop current and is moved along the circumference of the electrodes so that a stay of the arc on the electrodes is prevented this avoids local melting of the electrodes and the current interrupting performance thereby is enhanced. Further, in order to produce a strong magnetic drive force for the arc from the moment when the arc is generated, it has been known to constitute the arc running face portions also to serve as the contacting faces of the electrodes. Namely, the arc running face portion around the circumference of the electrode is projected and the center portion of the electrode is recessed, whereby the electrode is permitted to contact the opposing electrode through the arc running face portion.

However, an electrode configurated as explained above has the following drawback. Namely, since the electrode is provided with a plurality of arc guiding channels or spiral channels formed by cutting out the electrode and extending from the recessed center portion of the electrode to the circumference thereof and a plurality of arc running face portions dividedly defined by the respective arc guiding channels, an arc extended to the outer circumferential edge of the electrode after moving through an arc running face portion thereof stays at the end of the arc running face portion. When the arc stays in such a way, the electrode is locally heated by the arc to induce melting of the electrode which can cause interruption failure.

JP-A-60-74320(1985) and JP-A-61-29027(1986) disclose a structure of a vacuum circuit breaker in which the outer circumferential portions of a plurality of arc running face portions of an electrode defined by a plurality of arc guiding channels are connected by a metal member having a high electrical resistance to faciliate an arc to move to the adjacent arc running face portion. However, the disclosed vacuum circuit breaker requires other material than the electrode to be combined thereto which causes discontinuity of material on the electrode sense an arc voltage in a vacuum depends on the electrode material used and the arc in the vacuum stabilizes at a material having a low arc voltage. Accordingly, depending on the combination of materials used, the arc is likely to stay, once at the boundary between the electrode material and the inserted member. Further, in a structural sense, a step is likely to occur at the connecting portion of the two materials and the arc can stay at the connecting portion.

Further, a plurality of divided arc running face portions are structured to be firmly secured through one end thereof at the electrode center portion, and the arc running face portions are likely to be deformed such as by an impact when the arc running face portions are contacted with the opposing arc running face portions of the electrodes. When the arc running face portions are deformed, the electrodes can not make a uniform contact which increases the contact resistance thereof. The increase of the contact resistance causes inconveniences such as abnormal heating of the electrodes. For resolving such inconveniences JP-A-63-158722(1988) discloses an improved electrode structure for a vacuum circuit breaker. The improved electrode structure is explained by making use of FIGS. 7 and 8 which illustrate one of the embodiments of the present invention. Namely, the electrode 20 is provided with a ring shaped connecting portion 14A (only a part thereof is illustrated in FIG. 7 for explanation) at the side facing the opposing electrode which connects a plurality of adjoining arc running face portions 5 divided by a plurality of arc guiding channels 13 and an arc is magnetically driven over the ring shaped connecting portion 14A.

In the disclosed electrode 20, since the width of the ring shaped connecting portion 14A determined by the difference between the outer diameter and the inner diameter thereof is too broad in comparison with the ring shaped connecting portion 14 of the present invention illustrated at the same time in FIG. 7, the length of a current passage for a branching interrupting current $i_3$ on one arc running face portion 5 is substantially the same as the length of a current passage for a branching interrupting current $i_3'$ on an adjoining arc running face portion 5 so that the magnetic arc driving forces are weak and the arc is likely to stay. The reason of for introducing the ring shaped connecting portion 14A having a broad width is presumed that since the ring shaped connecting portion 14A is secured to the arc running face portions 5 by a solder material such as silver solder, when an arc is magnetically driven over the ring shaped connecting portion 14A, the ring shaped connecting portion 14A is possibly heated to a high temperature to melt the silver solder and to cause an interruption failure so that the width of the ring shaped connecting portion 14A is increased to enhance the cooling capacity thereof and to prevent the possible melting of the silver solder. According to experimental study performed by the present inventors on the electrode disclosed, it was observed that the electrode disclosed has drawnbacks that an arc is likely to stay thereat which possibly causes the heating up of the electrode melting the silver solder and finally a current interruption failure.

SUMMARY OF THE INVENTION

An object of the present invention is to provide an electrode for a vacuum circuit breaker of which current interrupting capacity can be freely designed and the size and weight of which can be also freely designed depending on the current interrupting capacity.

An electrode for a vacuum circuit breaker which achieves the above object constitutes one of a pair of separable electrodes disposed in a vacuum vessel and at least a pair of conductors connected thereto and extending outwardly from the vacuum vessel without breaking vacuum therein, and the electrode is provided with a plurality of arc guiding channels extending from the center side thereof to the outer circumferential side thereof and plurality of arc running face portions defined by a plurality of said arc guiding channels and a connecting portion of the same material as the arc running face portion having the same resistivity connecting integrally the respective adjoining arc running face portions across the corresponding arc guiding channel at the outer circumferential end thereof, wherein the cross sectional area constituting a current passage of the connecting portion is adjusted so as to control current flowing thereinto from the adjoining arc running face portions when the lengths of the current passages on the adjoining arc running face portions are different.

More specifically, when assuming the outer diameter of the connecting portion as $D_1$ and the inner diameter of the connecting portion as $D_2$, the width of the connecting portion is designed so as to satisfy the ratio $D_2/D_1$ to be in a range of more than 0.9 and less than 1.0.

DETAILED DESCRIPTION OF THE PREFERRED EMBODIMENTS

Hereinbelow an embodiment of the present is explained with reference to FIG. 1 through FIG. 5.

Figure 5:
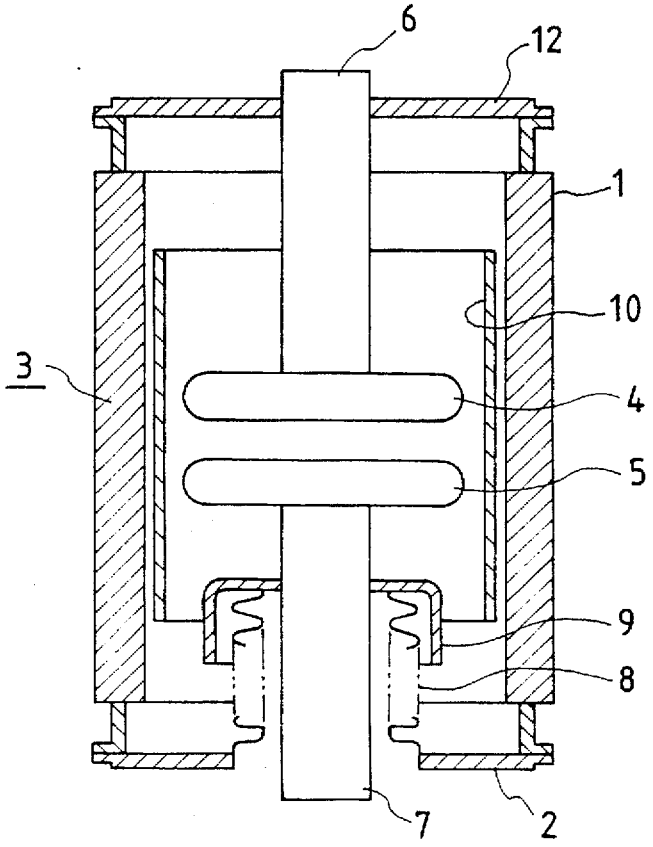
FIG. 5 is a sectional side view of a vacuum circuit breaker to which the present invention is applied.

FIG. 5 shows an over view of a vacuum circuit breaker. A vacuum vessel 3 is constituted by an insulator cylinder 1 and a pair of end plates 2 and 12 secured at the both ends of the insulator cylinder 1. In the vacuum vessel 3 a pair of a stationary electrode 4 and a movable electrode 5 are disposed, and from the respective back faces of the electrodes toward the outside of the insulator vessel 3 a pair of conductors 6 and 7 are extended without breaking the vacuum in the vessel. Between the conductor 7 at the side of the movable electrode 5 and the end plate 2 a bellows 8 is secured. The bellows 8 is disposed between a fixture metal member 9 secured to the conductor 7 at the side of the movable electrode 5 and the end plate 2. The bellows 8 works to permit the conductor 7 at the side of the movable electrode 5 to move in the axial direction via an operating mechanism (not shown) coupled to the conductor 7 at the side of the movable electrode 5 without breaking the vacuum in the vacuum vessel 3. Through the axial movement of the conductor 7 at the side of the movable electrode 5 the stationary electrode 4 and the movable electrode 5 can be electrically contacted and separated. A shield 10 is provided adjacent the inner surface of the insulator cylinder 1 so as to deposit microscopic metal particles produced by an arc generated between the electrodes when the movable electrode 5 is separated from the stationary electrode 4.

The structure of the stationary electrode 4 and the movable electrode 5 is explained with reference to FIG. 1 through FIG. 4. Since the structure of both electrodes is identical, the movable electrode 5 is taken up as an example and the structure thereof is explained, and the explanation of the stationary electrode is omitted. The movable electrode 5 is primarily constituted by a metal layer 11 having a high electrical conductivity such as copper and another metal layer 12 having an arc resistance such as chromium copper. The combination of the high electrical conductivity metal layer 11 and the arc resistance metal layer 12 is manufactured in such a way that a chromium powder is compressed to form a green compact of cylindrical shape and the cylindrical shaped green compact is then heated to form a sintered alloy. After setting the sintered alloy in a cylindrical shaped mold, molten copper is poured into the mold to form an infiltrated alloy. At this instance, air in voids in the sintered alloy is replaced by the molten copper and removed. Therefore the electrodes using such infiltrated alloy do not deteriorate the vacuum when the same is disposed in a vacuum vessel and an evacuuating process is performed. The above electrodes are formed by cutting the infiltrated alloy. The boundary layer between the high electrical conductivity metal layer 11 and the arc resistance metal layer 12 constitutes an alloy having a higher melting point than a solder material such as silver solder, and that is hardly meltable. Moreover, the allow has a high arc resistance which also contributes to improve the current interrupting capacity of the electrode.

The movable electrode 5 is provided with a center recessed portion 5A and arc running face portions 5B, 5C and 5D surrounding the center recessed portion 5A, and formed integrally therewith and serving also as the contacting face. The respective arc running face portions 5B, 5C and 5D are defined by arc guiding channels 13A, 13B and 13C cut in the electrode 5 extending from the outer circumference of the center recessed portion 5A is a spiral shape to a position just short of the outer circumference or wall 5E of the electrode 5. Respective connecting portions 14 cross over the respective arc guiding channels 13A, 13B and 13C at the outer circumference 5E of the electrode 5 while defining the outer circumferential ends of the respective arc guiding channels 13A, 13B and 13C on the respective arc running face portions 5B, 5C and 5D and connecting the respective adjoining arc running face portions at the outer peripheries thereof. In other words, the respective connecting portions 14 serve to bridge across the respective arc guiding channels. Further, the respective connecting portions 14 are constituted by an electrically conductive material having the same resistivity as that of the respective arc running face portions 5B, 5C and 5D and are formed integrally with the respective arc running face portions 5B, 5C and 5D.

For this reason, heat generation, when an arc runs over the respective arc running face portions 5B, 5C and 5D and the connecting portions 14, is suppressed and the current interrupting capacity of the electrode is improved. Further, through the integration of the respective arc running face portions 5B, 5C and 5D and the respective connecting portions 14, the heights thereof can be reduced which reduces the axial length of the electrode in comparison with the embodiment shown in FIG. 8 and further eliminates an electric field concentration. In other words, electric field concentration, is relaxed which further contributes to improvement of the current interrupting capacity of the electrode.

Figure 1:
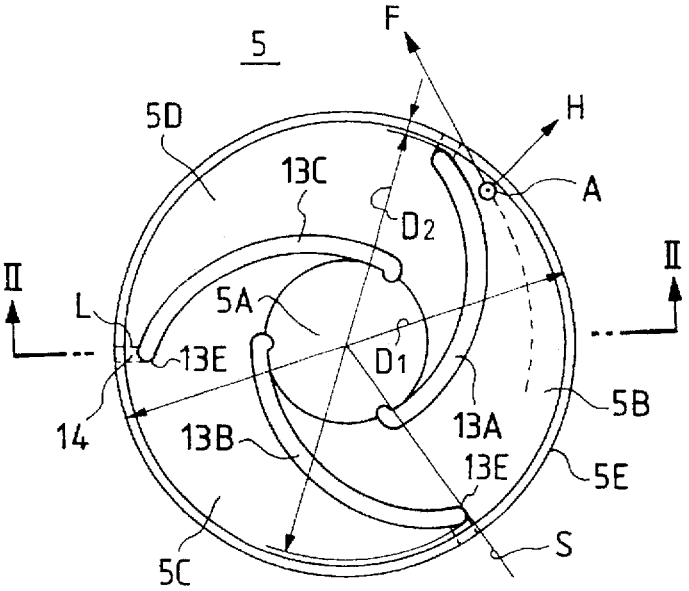
FIG. 1 is a plan view of an embodiment of a movable electrode according to the present invention which is used for a vacuum circuit breaker as shown in FIG. 5.
Figure 2:
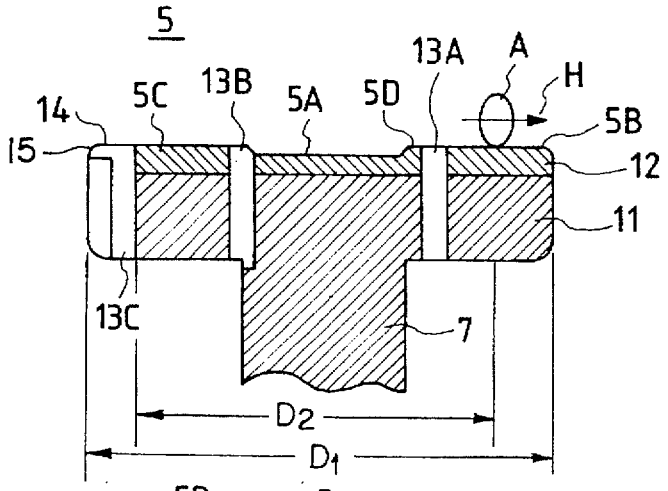
FIG. 2 is a cross sectional view taken along the line II—II in FIG. 1.
Figure 3:
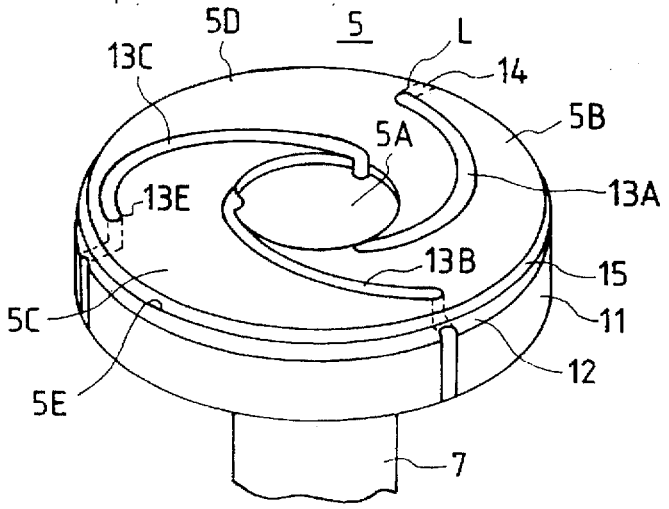
FIG. 3 is a perspective view of the movable electrode shown in FIG. 1.
Figure 4:
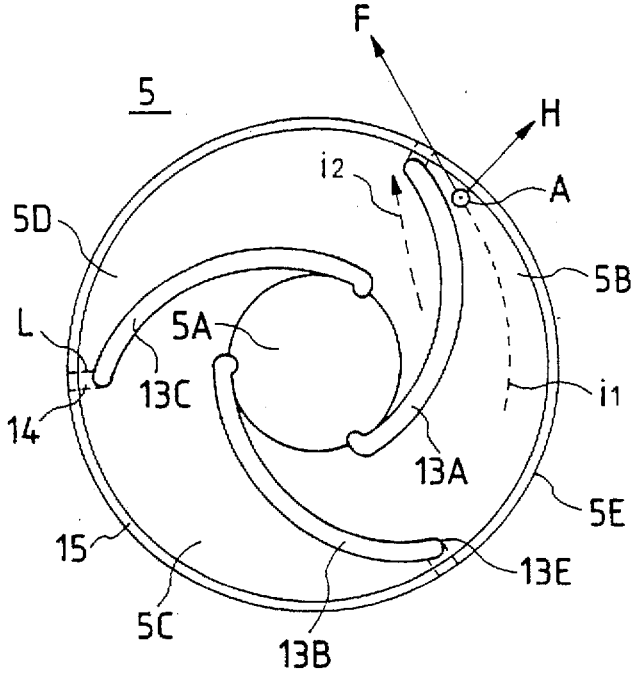
FIG. 4 is the same plan view of the movable electrode shown in FIG. 1 for explaining the function thereof.

When assuming an arc A runs to the position as illustrated in FIG. 4, a branching current $i_1$ flows along the arc running face portion 5B and another branching current $i_2$ flows along the adjoining arc running face portion 5D toward the arc A, and the current passage for the branching current $i_1$ is longer than the current passage for the other branching current $i_2$. However, in the present embodiment, the width L of the respective connecting portions 14 determined by the difference between the outer diameter $D_1$ and the inner diameter $D_2$ as shown in FIG. 2 thereof is adjustably determined so as to permit the branching current $i_1$ to easily flow toward the adjoining arc running face portion 5D through the concerned connecting portion 14, in other words, so as not to prevent the arc A from moving by the other branching current $i_2$. More specifically the ratio $D_2/D_1$ is selected in a range of more than 0.9 and less than 1.0.

When the stationary electrode 4 and the movable electrode 5 are disposed in an opposing manner as illustrated in FIG. 5, the passage of the branching current $i_1$ flowing through the electrodes is regulated as explained above to thereby constitute a round trip like current passage in substantially the circumferential direction. By means of magnetic field H induced by the branching current $i_1$ flowing through the above explained current passage, the arc A generated between the electrodes is driven in the circumferential direction to move over the arc running face portion.

The present inventors observed the following phenomenon. Namely, for example, when the arc A moves over the arc running face portion 5B and comes to the boundary with the arc running face portion 5D, the arc A is expected to pass through the concerned connecting portion 14 and to shift to the arc running face portion 5D. However, over the running face portion 5D a branching current $i_2$ is already flowing which operates to prevent the current $i_1$ from flowing into the arc running face portion 5D, to cause the arc A to stay near the concerned connection portion 14 which induces a local over heating of the electrode and a resultant local melting to possibly lead to a current interruption failure.

In view of the above observation, the present inventors resolved the above problem by controlling the branching currents $i_1$ and $i_2$ tending to flow through the concerned connecting portion 14 by determining the cross section of the connecting portion 14 serving as the current passage by adjusting such as the width and thickness thereof. Namely, when assuming the outer diameter of the connecting portion 14 as $D_1$ and the inner diameter thereof as $D_2$, the ratio $D_2/D_1$, is set in a range of more than 0.9 and less than 1.0. As a result, the arc A is properly driven magnetically over the concerned arc running face portion in the circumferential direction and thereby the current interrupting capacity of the electrodes is greatly increased. For example, when assuming the current interrupting capacity of a conventional electrode is 1 in which the width L of the connecting portion is not adjusted as in the present invention, the current interrupting capacity of the present electrode is increased up to 2. Therefore, in correspondence with the increased current interrupting capacity, the size and the weight of the present electrode can be reduced in comparison with those of the conventional one.

If a ratio $D_2/D_1$ of less than 0.9 is selected for the connecting portion 14, the width L of the connecting portion 14 is comparatively enlarged and a comparatively large branching current $i_2$ can flow into the connecting portion 14 which prevents the arc A from moving through the connecting portion 14 and causes the arc A to stay at the connecting portion 14 which can cause a current interruption failure.

If the ratio $D_2/D_1$ comes close to 1.0, the width L of the connecting portion 14 is minimized and substantially no branching current $i_2$ flows through the concerned connecting portion 14. Therefore the magnetic field H induced by the current $i_1$ is increased and the arc A is possibly driven out from the electrode to hit the shield 10 by the strong electro magnetic force induced by the strong magnetic field H and the large branching current $i_1$ which renders the vacuum circuit breaker inoperable. Through the setting of the ratio $D_2/D_1$ in a range of more than 0.9 and less than 1.0, the branching currents $i_1$ and $i_2$ flowing through the concerned connecting portion 14 are properly controlled. In this instance, if the branching current $i_2$ is primarily controlled in stead of the branching current $i_1$, the length L of the concerned connecting portion 14 can be reduced which will bring about an advantage of reducing the weight of the electrode. As will be understood from the above, with the mere adjustment of the width L of the connecting portion, the current interrupting capacity of the electrode can be varied and thus, depending on the required current interrupting capacity, the size and weight of the electrode can be freely designed. It is further preferable to adjust the thickness of the connecting portion 14 which will be explained later in addition to the adjustment of width L thereof.

The following Table shows a performance comparison of electrodes of different diameters according to the present invention and the conventional electrodes disclosed in JP-A-63-158722 (1988) depending on the difference in ratio $D_2/D_1$.

Comparison Table of Electrode Performance

| electrode connecting portion of the invention | | | | | electrode of JP-A-63-158722 | | |
|---|---|---|---|---|---|---|---|
| outer diameter D1 (mm) | width L (mm) | inner diameter D2 (mm) | D2/D1 | interruptable current limit (KA) | width L (mm) (D2/D1 = 0.6) | width L (mm) D2/D1 = 0.9) | interruptable current limit (KA) (when D2/D1 = 0.6) |
| 20 | 0.8 | 18.4 | 0.920 | 9 | 4.00 | 1.00 | |
| 30 | 1.2 | 27.6 | 0.920 | 14 | 6.00 | 1.50 | 8 |
| 40 | 1.8 | 36.4 | 0.910 | 23 | 8.00 | 2.00 | |
| 50 | 2.0 | 46.0 | 0.920 | 30 | 10.00 | 2.50 | 16 |
| 60 | 2.0 | 56.0 | 0.933 | 41 | 12.00 | 3.00 | |
| 70 | 2.0 | 66.0 | 0.943 | 56 | 14.00 | 3.50 | 25 |
| 80 | 2.0 | 76.0 | 0.950 | 65 | 16.00 | 4.00 | |
| 100 | 2.0 | 96.0 | 0.960 | 80 | 20.00 | 5.00 | |

When comparing the interruptable currents in the second, fourth and sixth rows in the Table, it will be seen that the interuptable current of the electrode according to the present invention is about two times of that of the conventional electrode.

Modifications of the above embodiment and other embodiments are explained hereinbelow.

(1) When the connecting portion 14, of which the cross sectional area determining current path is controlled, is provided at the portion between the outer circumferential end 13E of the arc guiding channel 13B, for example, and the outer circumferential end 5E of the electrode 5 having the narrowest width, in that, when the one side of the connecting portion 14 is provided in alignment with a tangent line S connecting the center of the electrode 5 and the outer most end 13E of a concerned arc guiding channel and the other side of the connecting portion 14 is also located in the same side with reference to the tangent line S at the outer periphery of the electrode 5, the adjustment of the cross sectional area of the connecting portion 14 for controlling the branching currents $i_1$ and $i_2$ is facilitated and the efficiency of adjustment work is improved.

(2) It is preferable to set the thickness of the connecting portion 14 in a range of 0.5~5 mm. If the thickness exceeds 5 mm, the connecting portion 14 reaches to the electrically high conductivity metal layer 11 which permits the branching current $i_2$ of comparatively large amount to flow into the connecting portion 14 and reduces the magnetic force induced by the current $i_1$ for driving the arc A. Thereby, the electrode suffers the same drawbacks as explained above. Further, if the thickness lowers below 0.5 mm, the connecting portion 14 on the electrode is easily worn by the arc A which reduces the mechanical strength of the electrode and shortens the life time thereof, in that non-economical.

As will be apparent from the above, when the thickness of the connecting portion 14 as well as the width thereof are adjusted in combination, the control of the branching currents $i_1$ and $i_2$ is further effectively performed.

(3) It is further preferable to form a rounded face 15 at the outer circumferential ends of the respective arc running face portions 5B, 5C and 5D in a rounding range of 0.5 mm~1.5 mm. If a rounding of less than 0.5 mm is provided, the dielectric breakdown voltage of the electrode lowers and the electrode is likely to cause discharging, and if a rounding of more than 1.5 mm is provided, the arc A is likely to grow and to expand toward the shield 10 which may increase the size of the vacuum circuit breaker.

Figure 6:
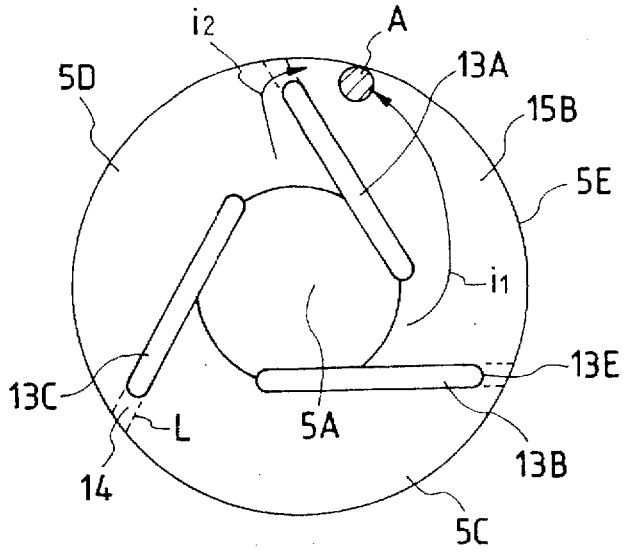
FIG. 6 is a plan view of another embodiment of an electrode for a vacuum circuit breaker according to the present invention.

(4) The arc guiding channels 13A, 13B and 13C can be in a stright line shape extending from the center recessed portion 5A to the outer circumferential ends of the arc running face portions as illustrated in FIG. 6. In this instance the connecting portions 14 are of course provided respectively at the portions between outer circumferential ends of the respective arc guiding channels 13A, 13B and 13C and the outer circumference or wall of the arc running face portions 5B, 5C and 5D.

Figure 7:
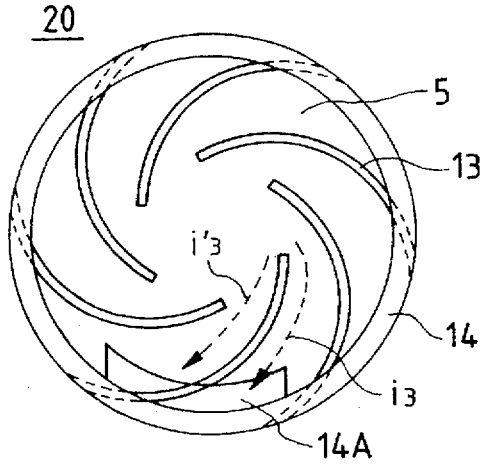
FIG. 7 is a plan view of still another embodiment of an electrode for a vacuum circuit breaker according to the present invention.
Figure 8:
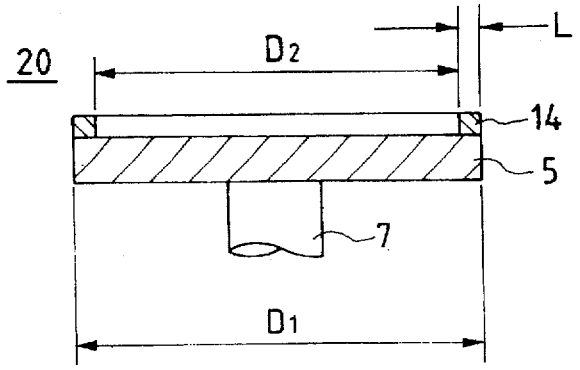
FIG. 8 is a cross sectional view of the electrode shown in FIG. 7.

(5) In the FIGS. 7 and 8 embodiment, the electrode 20 is provided with a plurality of arc guiding channels 13 and a plurality of arc running face portions 5 defined by the plurality of arc guiding channels 13, and further provided with a ring shaped connecting portion 14 disposed around the outer circumferential periphery of the electrode 5 bridging the respective arc guiding channels and connecting the respective arc running face portions and facing the opposing electrode. In the same way as in the first embodiment, the width L of the ring shaped connecting portion 14 is determined so as to satisfy the ratio $D_2/D_1$ in a range more than 0.9 and less than 1.0 so that even if the current passage for a branching current $i_3$ is longer than the current passage for a branching current $i_3'$ the arc A is moved toward the adjoining arc running face portion through the ring shaped connecting portion 14.

With the present invention, the current interrupting capacity of the electrode for a vacuum circuit breaker can be freely varied and thus depending on the required current interrupting capacity, the size and weight of the electrode can be freely designed.

We claim:

1. An electrode for a vacuum circuit breaker which constitutes one pair of separable electrodes disposed in a vacuum vessel and at least a pair of conductors connected thereto and extending outwardly from the vacuum vessel without breaking the vacuum therein, each electrode being provided with a plurality of arc guiding channels extending from a center thereof to an outer circumference thereof, a plurality of arc running face portions defined by said plurality of arc guiding channels and a connecting portion made of a material having a resistivity the same as a resistivity of the arc running face portions, integrally connecting respective adjoining arc running face portions across a corresponding arc guiding channel at the outer circumference thereof, wherein a cross sectional area constituting a current passage of the connecting portion is adjustably determined so as to limit currents flowing therethrough from one of the adjoining arc running face portions to another of the arc running face portions where an arc is generated when a length of a current passage on the one of the adjoining arc running face portions to the generated arc on the other adjoining arc running face portion becomes shorter than that on the other adjoining arc running face portion.

2. An electrode for a vacuum circuit breaker according to claim 1, wherein surface levels of the connecting portion and an adjoining arc running face are equated.

3. An electrode for a vacuum circuit breaker according to claim 1, wherein a same material is used for the connecting portion and the arc running face portions.

4. An electrode for a vacuum circuit breaker according to claim 1, wherein a connecting portion is disposed at a vicinity between an outer end of respective arc guiding channels and the outer circumference of the electrode along a tangential line connecting a center of the electrode and said outer end of said respective arc guiding channels.

5. An electrode for a vacuum circuit breaker according to claim 1, wherein an infiltration alloy is used for the electrode which is formed by pouring a molten metal having a high electrical conductivity in a sintered alloy of arc resistance metal having voids therein.

6. An electrode for a vacuum circuit breaker according to claim 1, wherein a thickness of the connecting portion for said respective arc guiding channels is set in a range of 0.5~5 mm.

7. An electrode for a vacuum circuit breaker according to claim 1, wherein the outer circumferences of the arc running face portions are formed into a rounded surface in a rounding range of 0.5~1.5 mm.

8. An electrode for a vacuum circuit breaker according to claim 1, wherein an outer diameter of the connecting portion is $D_1$ and an inner diameter of the connecting portion is $D_2$, a width of the connecting portion is designed so that a ratio $D_2/D_1$ is in a range of more than 0.9 and less than 1.0, a thickness of the connecting portion for the respective arc guiding channels is set in a range of 0.5–5 mm, and outer circumferences of said arc running face portions are formed into a rounded surface in a rounding range 0.5–5 mm.

9. An electrode for a vacuum circuit breaker which constitutes one of a pair of separable electrodes disposed in a vacuum vessel and at least a pair of conductors connected thereto and extending outwardly from the vacuum vessel without breaking the vacuum therein, each electrode being provided with a plurality of arc guiding channels extending from a center thereof to an outer circumference thereof, a plurality of arc running face portions defined by a plurality of said arc guiding channels and a connecting portion made of a material having a resistivity the same as a resistivity of the arc running face portions integrally connecting respective adjoining arc running face portions across a corresponding arc guiding channel at the outer circumference thereof, wherein a cross sectional area constituting a current passage of the connecting portion is adjustably determined so as to limit currents flowing therethrough from adjoining arc running face portions when lengths of current passages on the adjoining arc running face portions are different in a way that when an outer diameter of the connecting portion is $D_1$ and an inner diameter of the connecting portion is $D_2$, a width of the connecting portion is designed so that a ratio $D_2/D_1$ is in a range of more than 0.9 and less than 1.0.

10. An electrode for a vacuum circuit breaker according to claim 9, wherein surface levels of the connecting portion and an adjoining arc running face are equated.

11. An electrode for a vacuum circuit breaker according to claim 9, wherein a same material is used for the connecting portion and the arc running face portions.

12. An electrode for a vacuum circuit breaker according to claim 9, wherein a connecting portion is disposed at the vicinity between an outer end of respective arc guiding channels and the outer circumferences of the electrode along a tangential line connecting a center of the electrode and said outer end of said respective arc guiding channels.

13. An electrode for a vacuum circuit breaker according to claim 9, wherein an infiltration alloy is used for the electrode which is formed by pouring a molten metal having a high electrical conductivity in a sintered alloy of arc resistance metal having voids therein.

14. An electrode for a vacuum circuit breaker according to claim 9, wherein a thickness of the connecting portion for said respective arc guiding channels is set in a range of 0.5~5 mm.

15. An electrode for a vacuum circuit breaker according to claim 9, wherein outer circumferences of the arc running face portions are formed into a rounded surface in a rounding range of 0.5–1.5 mm.

16. An electrode for a vacuum circuit breaker which constitutes one of a pair of separable electrodes disposed in a vacuum vessel and at least a pair of conductors connected thereto and extending outwardly from the vacuum vessel without breaking the vacuum therein, each electrode being provided with a plurality of arc guiding channels extending from a center thereof to an outer circumference thereof, a plurality of arc running face portions defined by said plurality of arc guiding channels and a ring shaped connecting portion disposed around an outer circumference of the electrode bridging respective arc guide channels and connecting respective arc running face portions and facing an opposing electrode, wherein a cross sectional area constituting a current passage of the ring shaped connecting portion is adjustably determined so as to limit currents flowing therethrough from adjoining arc running face portions when lengths of current passages on adjoining arc running face portions are different whereby when an outer diameter of the ring shaped connecting portion is $D_1$ and an inner diameter of the connecting portion is $D_2$, a width of the ring shaped connecting portion is designed so that a ratio $D_2/D_1$ is in a range of more than 0.9 and less than 1.0.

* * * * *